US010450840B2

(12) United States Patent
Xu

(10) Patent No.: US 10,450,840 B2
(45) Date of Patent: Oct. 22, 2019

(54) MULTIFUNCTIONAL DOWNHOLE TOOLS

(71) Applicant: Zhiyue Xu, Cypress, TX (US)

(72) Inventor: Zhiyue Xu, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 119 days.

(21) Appl. No.: 15/385,021

(22) Filed: Dec. 20, 2016

(65) Prior Publication Data

US 2018/0171757 A1 Jun. 21, 2018

(51) Int. Cl.

| | |
|---|---|
| ***E21B 29/02*** | (2006.01) |
| ***E21B 41/00*** | (2006.01) |
| ***E21B 47/06*** | (2012.01) |
| ***E21B 47/00*** | (2012.01) |

(52) U.S. Cl.

CPC ..... *E21B 41/00* (2013.01); *E21B 47/00* (2013.01); *E21B 47/06* (2013.01); *E21B 47/065* (2013.01)

(58) Field of Classification Search

CPC ..... E21B 29/02
USPC ..... 166/376
See application file for complete search history.

(56) References Cited

U.S. PATENT DOCUMENTS

| | | | |
|---|---|---|---|
| 2,637,402 A | 5/1953 | Baker et al. | |
| 2,695,064 A | 11/1954 | Ragan et al. | |
| 5,052,489 A | 10/1991 | Carisella et al. | |
| 5,386,780 A | 2/1995 | Klein | |
| 5,680,905 A | 10/1997 | Green et al. | |
| 5,911,277 A | 6/1999 | Hromas et al. | |
| 6,253,843 B1 | 7/2001 | Rawson et al. | |
| 7,270,191 B2 | 9/2007 | Drummond et al. | |
| 8,056,638 B2 | 11/2011 | Clayton et al. | |
| 8,235,102 B1 | 8/2012 | Robertson | |
| 8,256,521 B2 | 9/2012 | Swor et al. | |
| 8,272,446 B2 | 9/2012 | Swor et al. | |
| 8,291,969 B2 | 10/2012 | Swor et al. | |
| 8,291,970 B2 | 10/2012 | Swor et al. | |
| 8,322,449 B2 | 12/2012 | Clayton et al. | |
| 8,403,037 B2 | 3/2013 | Agrawal et al. | |
| 8,485,265 B2 * | 7/2013 | Marya | E21B 23/00 166/214 |
| 8,528,633 B2 | 9/2013 | Agrawal et al. | |
| 9,022,107 B2 | 5/2015 | Agrawal et al. | |
| 9,101,978 B2 | 8/2015 | Xu et al. | |

(Continued)

FOREIGN PATENT DOCUMENTS

| | | |
|---|---|---|
| EP | 0122012 A2 | 10/1984 |
| WO | 2013022635 A2 | 2/2013 |

OTHER PUBLICATIONS

International Search Report for International Application No. PCT/US2017/062275, dated Mar. 12, 2018, 4 pages.

(Continued)

*Primary Examiner* — Kenneth L Thompson
(74) *Attorney, Agent, or Firm* — Cantor Colburn LLP

(57) ABSTRACT

A downhole assembly comprises a disintegrable article that includes a matrix material; an energetic material configured to generate energy upon activation to facilitate the disintegration of the disintegrable article; and a sensor. A method of controllably removing a disintegrable downhole article comprises disposing the downhole article in a downhole environment; performing a downhole operation; activating the energetic material; and disintegrating the downhole article.

27 Claims, 7 Drawing Sheets

(56) References Cited

U.S. PATENT DOCUMENTS

| | | | | |
|---|---|---|---|---|
| 9,267,347 | B2 | 2/2016 | Agrawal et al. | |
| 9,334,719 | B2 | 5/2016 | Rytlewski et al. | |
| 9,656,926 | B1 | 5/2017 | Thoma et al. | |
| 9,689,247 | B2 * | 6/2017 | Holder | E21B 43/263 |
| 2007/0209802 | A1 | 9/2007 | Xu et al. | |
| 2010/0101803 | A1 | 4/2010 | Clayton et al. | |
| 2013/0081825 | A1 | 4/2013 | Lynde et al. | |
| 2013/0118805 | A1 | 5/2013 | Moody-Stuart et al. | |
| 2013/0160992 | A1 | 6/2013 | Agrawal et al. | |
| 2014/0014339 | A1 | 1/2014 | O'Malley et al. | |
| 2014/0190685 | A1 | 7/2014 | Frazier et al. | |
| 2014/0202712 | A1 | 7/2014 | Fripp et al. | |
| 2014/0251612 | A1 | 9/2014 | Powers | |
| 2014/0262327 | A1 | 9/2014 | Ku et al. | |
| 2014/0345878 | A1 | 11/2014 | Murphree et al. | |
| 2014/0363692 | A1 | 12/2014 | Marya et al. | |
| 2015/0021023 | A1 | 1/2015 | Roberts et al. | |
| 2015/0027723 | A1 | 1/2015 | Fripp et al. | |
| 2015/0190984 | A1 | 7/2015 | Zhang et al. | |
| 2015/0239795 | A1 | 8/2015 | Doud et al. | |
| 2015/0259263 | A1 | 9/2015 | Sherman et al. | |
| 2015/0292288 | A1 | 10/2015 | Kasperski et al. | |
| 2016/0130906 | A1 | 5/2016 | Garvey et al. | |
| 2016/0186044 | A1 * | 6/2016 | Rothrock | C09K 8/58 166/300 |
| 2016/0209391 | A1 | 7/2016 | Zhang et al. | |
| 2016/0333668 | A1 | 11/2016 | Xu et al. | |
| 2017/0009563 | A1 | 1/2017 | Holder | |
| 2017/0138169 | A1 * | 5/2017 | Bogdan | E21B 33/12 |
| 2017/0218722 | A1 | 8/2017 | Gordon et al. | |
| 2018/0171736 | A1 | 6/2018 | Xu et al. | |
| 2018/0171737 | A1 | 6/2018 | Xu et al. | |
| 2018/0171738 | A1 | 6/2018 | Xu et al. | |
| 2018/0230769 | A1 * | 8/2018 | Xu | C06B 33/00 |
| 2018/0230770 | A1 * | 8/2018 | Oag | E21B 33/12 |
| 2018/0245448 | A1 * | 8/2018 | Fripp | E21B 47/00 |
| 2018/0252070 | A1 * | 9/2018 | Zhu | C09K 8/508 |
| 2018/0283121 | A1 | 10/2018 | Zhang et al. | |
| 2018/0283141 | A1 | 10/2018 | Zhang et al. | |
| 2018/0283142 | A1 | 10/2018 | Zhang et al. | |
| 2018/0334873 | A1 | 11/2018 | Marya | |
| 2019/0078410 | A1 | 3/2019 | Xu et al. | |

OTHER PUBLICATIONS

Written Opinion of the International Search Report for International Application No. PCT/US2017/062275, dated Mar. 12, 2018, 12 pages.

International Search Report, International Application No. PCT/US2017/062263, dated Feb. 22, 2018, Korean Intellectual Property Office; International Search Report 7 pages.

International Written Opinion, International Application No. PCT/US2017/062263, dated Feb. 22, 2018, Korean Intellectual Property Office; International Written Opinion 11 pages.

U.S. Appl. No. 15/472,382, filed Mar. 29, 2017, Entitled: Downhole Tools Having Controlled Disintegration, First Named Inventor: Zhihui Zhang.

Huang et al., "Construction and Properties of Structure- and Size-controlled Micro/nano-Energetic Materials", Defence Technology 9 (2013) 59-79.

Notification of Transmittal of the International Search Report and The Written Opinion of the International Searching Authority; PCT/US2018/047315; dated Dec. 21, 2018; 12 pages.

* cited by examiner

MULTIFUNCTIONAL DOWNHOLE TOOLS

BACKGROUND

Oil and natural gas wells often utilize wellbore components or tools that, due to their function, are only required to have limited service lives that are considerably less than the service life of the well. After a component or tool service function is complete, it must be removed or disposed of in order to recover the original size of the fluid pathway for use, including hydrocarbon production, $CO_2$ sequestration, etc. Disposal of components or tools has conventionally been done by milling or drilling the component or tool out of the wellbore, which are generally time consuming and expensive operations.

Recently, self-disintegrating or interventionless downhole tools have been developed. Instead of milling or drilling operations, these tools can be removed by dissolution of engineering materials using various wellbore fluids. Because downhole tools are often subject to high pressures, a disintegrable material with a high mechanical strength is often required to ensure the integrity of the downhole tools. In addition, the material must have minimal disintegration initially so that the dimension and pressure integrities of the tools are maintained during tool service. Ideally the material can disintegrate rapidly after the tool function is complete because the sooner the material disintegrates, the quicker the well can be put on production.

One challenge for the self-disintegrating or interventionless downhole tools is that the disintegration process can start as soon as the conditions in the well allow the corrosion reaction of the engineering material to start. Thus the disintegration period is not controllable as it is desired by the users but rather ruled by the well conditions and product properties. For certain applications, the uncertainty associated with the disintegration period and the change of tool dimensions during disintegration can cause difficulties in well operations and planning. An uncontrolled disintegration can also delay well productions. Therefore, the development of downhole tools that have minimal or no disintegration during the service of the tools so that they have the mechanical properties necessary to perform their intended function and then rapidly disintegrate in response to a customer command is very desirable. It would be a further advantage if such tools can also detect real time tool disintegration status and well conditions such as temperature, pressure, and tool position for tool operations and control.

BRIEF DESCRIPTION

A downhole assembly comprises a disintegrable article that includes a matrix material; an energetic material configured to generate energy upon activation to facilitate the disintegration of the disintegrable article; and a sensor.

A method of controllably removing a disintegrable downhole article comprises disposing the downhole article in a downhole environment, the downhole article including a matrix material, an energetic material configured to generate energy upon activation to facilitate the disintegration of the downhole article, and a sensor; performing a downhole operation; activating the energetic material; and disintegrating the downhole article.

BRIEF DESCRIPTION OF THE DRAWINGS

The following descriptions should not be considered limiting in any way. With reference to the accompanying drawings, like elements are numbered alike:

FIG. 6A illustrates a disintegrable article before activation; FIG. 6B illustrates the disintegrable article of FIG. 6A after activation; FIG. 6C illustrates an energetic material broken from the activated disintegrable article of FIG. 6B; FIG. 6D illustrates a matrix material broken from the activated disintegrable article of FIG. 6B; FIG. 6E illustrates a sensor material broken from the activated disintegrable article of FIG. 6B; and FIG. 6F illustrates a powder generated from the activated disintegrable article of FIG. 6B.

DETAILED DESCRIPTION

Figure 1:
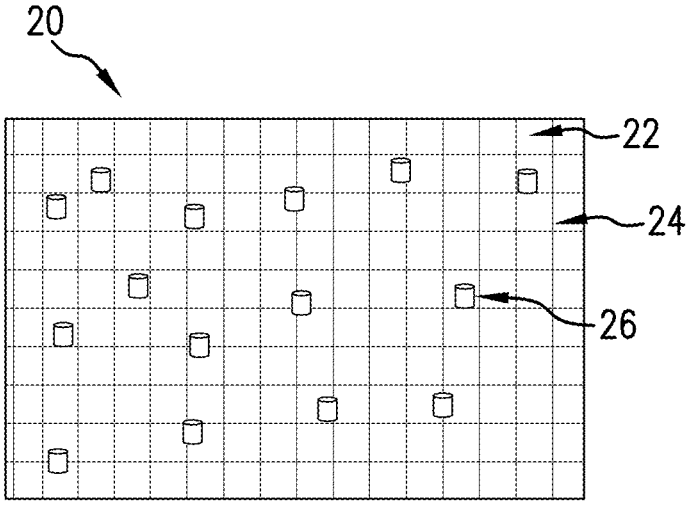
FIG. 1 is a schematic diagram of an exemplary disintegrable article that includes a matrix material, an energetic material, and a sensor, wherein the energetic material comprises interconnected fibers or wires.

The disclosure provides multifunctional downhole articles that can monitor tool disintegration status, tool positions and surrounding well conditions such as temperature, pressure, fluid type, concentrations, and the like. Meanwhile, the downhole articles have minimized disintegration rate or no disintegration while the articles are in service but can rapidly disintegrate in response to a triggering signal or activation command. The disintegrable articles include a matrix material; an energetic material configured to generate energy upon activation to facilitate the disintegration of the disintegrable article; and a sensor. The disintegration of the articles can be achieved through chemical reactions, thermal cracking, mechanical fracturing, or a combination comprising at least one of the foregoing.

The energetic material can be in the form of continuous fibers, wires, foils, particles, pellets, short fibers, or a combination comprising at least one of the foregoing. In the disintegrable articles, the energetic material is interconnected in such a way that once a reaction of the energetic material is initiated at one or more starting locations or points, the reaction can self-propagate through the energetic material in the disintegrable articles. As used herein, interconnected or interconnection is not limited to physical interconnection.

In an embodiment the energetic material comprises continuous fibers, wires, or foils, or a combination comprising at least one of the foregoing and forms a three dimensional network. The matrix material is distributed throughout the three dimensional network. A disintegrable article having such a structure can be formed by forming a porous preform from the energetic material, and filling or infiltrating the matrix material into the preform under pressure at an elevated temperature. The sensor can be placed at a random or a pre-determined location in the disintegrable article.

In another embodiment, the energetic material is randomly distributed in the matrix material in the form of particles, pellets, short fibers, or a combination comprising at least one of the foregoing. A disintegrable article having such a structure can be formed by mixing and compressing the energetic material and the matrix material. The sensor can be placed at a random or a pre-determined location in the disintegrable article.

In yet another embodiment, the disintegrable article comprises an inner portion and an outer portion disposed of the inner portion, where the inner portion comprises a core material that is corrodible in a downhole fluid; and the outer portion comprises the matrix material and the energetic material. The sensor can be disposed in the inner portion of the disintegrable article, the outer portion of the disintegrable article, or both. Illustrative core materials include corrodible matrix materials disclosed herein. The inner portion can include a core matrix formed from the core materials. Such a core matrix can have a microstructure as described herein for the corrodible matrix.

When the inner portion is surrounded and encased by the outer portion, the core material in the inner portion of the article and matrix material in the outer portion of the article are selected such that the core material has a higher corrosion rate than the matrix material when tested under the same conditions.

The outer portion of the articles can comprise a network formed by an energetic material in the form of continuous fibers, wires, or foils, or a combination comprising at least one of the foregoing, and a matrix material distributed throughout the network of the energetic material. The outer portion of the disintegrable articles can also contain an energetic material randomly distributed in a matrix material in the form of particles, pellets, short fibers, or a combination comprising at least one of the foregoing. In an embodiment, the outer portion has a layered structure including matrix layers and energetic material layers. An exemplary layered structure has alternating layers of a matrix material and an energetic material. The arrangement allows for selective removal of a portion of the disintegrable article upon selective activation of one or more layers of the energetic material.

Once the energetic material in the outer portion of the article is activated, the outer portion disintegrates exposing the inner portion of the article. Since the inner portion of the article has an aggressive corrosion rate in a downhole fluid, the inner portion of the article can rapidly disintegrate once exposed to a downhole fluid.

The matrix material comprises a polymer, a metal, a composite, or a combination comprising at least one of the foregoing, which provides the general material properties such as strength, ductility, hardness, density for tool functions. As used herein, a metal includes metal alloys. The matrix material can be corrodible or non-corrodible in a downhole fluid. The downhole fluid comprises water, brine, acid, or a combination comprising at least one of the foregoing. In an embodiment, the downhole fluid includes potassium chloride (KCl), hydrochloric acid (HCl), calcium chloride ($CaCl_2$), calcium bromide ($CaBr_2$) or zinc bromide ($ZnBr_2$), or a combination comprising at least one of the foregoing. The disintegration of the articles can be achieved through chemical reactions, thermal cracking, mechanical fracturing, or a combination comprising at least one of the foregoing. When the matrix material is not corrodible, the downhole article can be disintegrated by physical forces generated by the energetic material upon activation. When the matrix material is corrodible, the downhole article can be disintegrated by chemical means via the corrosion of the matrix material in a downhole fluid. The heat generated by the energetic material can also accelerate the corrosion of the matrix material. Both chemical means and physical means can be used to disintegrate downhole articles that have corrodible matrix materials.

In an embodiment, the corrodible matrix material comprises Zn, Mg, Al, Mn, an alloy thereof, or a combination comprising at least one of the foregoing. The corrodible matrix material can further comprise Ni, W, Mo, Cu, Fe, Cr, Co, an alloy thereof, or a combination comprising at least one of the foregoing.

Magnesium alloy is specifically mentioned. Magnesium alloys suitable for use include alloys of magnesium with aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), tungsten (W), zinc (Zn), zirconium (Zr), or a combination comprising at least one of these elements. Particularly useful alloys include magnesium alloy particles including those prepared from magnesium alloyed with Ni, W, Co, Cu, Fe, or other metals. Alloying or trace elements can be included in varying amounts to adjust the corrosion rate of the magnesium. For example, four of these elements (cadmium, calcium, silver, and zinc) have to mild-to-moderate accelerating effects on corrosion rates, whereas four others (copper, cobalt, iron, and nickel) have a still greater effect on corrosion. Exemplary commercial magnesium alloys which include different combinations of the above alloying elements to achieve different degrees of corrosion resistance include but are not limited to, for example, those alloyed with aluminum, strontium, and manganese such as AJ62, AJ50x, AJ51x, and AJ52x alloys, and those alloyed with aluminum, zinc, and manganese such as AZ91A-E alloys.

It will be understood that corrodible matrix materials will have any corrosion rate necessary to achieve the desired performance of the disintegrable article once the article completes its function. In a specific embodiment, the corrodible matrix material has a corrosion rate of about 0.1 to about 450 $mg/cm^2$/hour, specifically about 1 to about 450 $mg/cm^2$/hour determined in aqueous 3 wt. % KCl solution at 200° F. (93° C.).

In an embodiment, the matrix formed from the matrix material (also referred to as corrodible matrix) has a substantially-continuous, cellular nanomatrix comprising a nanomatrix material; a plurality of dispersed particles comprising a particle core material that comprises Mg, Al, Zn or Mn, or a combination thereof, dispersed in the cellular nanomatrix; and a solid-state bond layer extending throughout the cellular nanomatrix between the dispersed particles. The matrix comprises deformed powder particles formed by compacting powder particles comprising a particle core and at least one coating layer, the coating layers joined by solid-state bonding to form the substantially-continuous, cellular nanomatrix and leave the particle cores as the dispersed particles. The dispersed particles have an average particle size of about 5 μm to about 300 μm. The nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials. The chemical composition of the nanomatrix material is different than the chemical composition of the nanomatrix material.

The matrix can be formed from coated particles such as powders of Zn, Mg, Al, Mn, an alloy thereof, or a combination comprising at least one of the foregoing. The powder generally has a particle size of from about 50 to about 150 micrometers, and more specifically about 5 to about 300 micrometers, or about 60 to about 140 micrometers. The powder can be coated using a method such as chemical vapor deposition, anodization or the like, or admixed by physical method such cryo-milling, ball milling, or the like, with a metal or metal oxide such as Al, Ni, W, Co, Cu, Fe, oxides of one of these metals, or the like. The coating layer can have a thickness of about 25 nm to about 2,500 nm. Al/Ni and Al/W are specific examples for the coating layers. More than one coating layer may be present. Additional coating layers can include Al, Zn, Mg, Mo, W. Cu, Fe, Si, Ca, Co, Ta, Re, or No. Such coated magnesium powders are referred to herein as controlled electrolytic materials (CEM). The CEM materials are then molded or compressed forming the matrix by, for example, cold compression using an isostatic press at about 40 to about 80 ksi (about 275 to about 550 MPa), followed by forging or sintering and machining, to provide a desired shape and dimensions of the disintegrable article. The CEM materials including the composites formed therefrom have been described in U.S. Pat. Nos. 8,528,633 and 9,101,978.

The matrix material can be degradable polymers and their composites including poly(lactic acid) (PLA), poly(glycolic acid) (PGA), polycaprolactone (PCL), polylactide-co-glycolide, polyurethane such as polyurethane having ester or ether linkages, polyvinyl acetate, polyesters, and the like.

Optionally, the matrix material further comprises additives such as carbides, nitrides, oxides, precipitates, dispersoids, glasses, carbons, or the like in order to control the mechanical strength and density of the disintegrable article.

The energetic material comprises a thermite, a reactive multi-layer foil, an energetic polymer, or a combination comprising at least one of the foregoing. Use of energetic materials disclosed herein is advantageous as these energetic materials are stable at wellbore temperatures but produce an extremely intense exothermic reaction following activation, which facilitates the rapid disintegration of the disintegrable articles.

Thermite compositions include, for example, a metal powder (a reducing agent) and a metal oxide (an oxidizing agent) that produces an exothermic oxidation-reduction reaction known as a thermite reaction. Choices for a reducing agent include aluminum, magnesium, calcium, titanium, zinc, silicon, boron, and combinations including at least one of the foregoing, for example, while choices for an oxidizing agent include boron oxide, silicon oxide, chromium oxide, manganese oxide, iron oxide, copper oxide, lead oxide, and combinations including at least one of the foregoing, for example.

As used herein, energetic polymers are materials possessing reactive groups, which are capable of absorbing and dissipating energy. During the activation of energetic polymers, energy absorbed by the energetic polymers cause the reactive groups on the energetic polymers, such as azido and nitro groups, to decompose releasing gas along with the dissipation of absorbed energy and/or the dissipation of the energy generated by the decomposition of the active groups. The heat and gas released promote the disintegration of the disintegrable articles.

Energetic polymers include polymers with azide, nitro, nitrate, nitroso, nitramine, oxetane, triazole, and tetrazole containing groups. Polymers or co-polymers containing other energetic nitrogen containing groups can also be used. Optionally, the energetic polymers further include fluoro groups such as fluoroalkyl groups.

Exemplary energetic polymers include nitrocellulose, azidocellulose, polysulfide, polyurethane, a fluoropolymer combined with nano particles of combusting metal fuels, polybutadiene; polyglycidyl nitrate such as polyGLYN, butanetriol trinitrate, glycidyl azide polymer (GAP), for example, linear or branched GAP, GAP diol, or GAP triol, poly[3-nitratomethyl-3-methyl oxetane](polyNIMMO), poly(3,3-bis-(azidomethyl)oxetane (polyBAMO) and poly (3-azidomethyl-3-methyl oxetane) (polyAMMO), polyvinylnitrate, polynitrophenylene, nitramine polyethers, or a combination comprising at least one of the foregoing.

The reactive multi-layer foil comprises aluminum layers and nickel layers or the reactive multi-layer foil comprises titanium layers and boron carbide layers. In specific embodiments, the reactive multi-layer foil includes alternating aluminum and nickel layers.

The amount of the energetic material is not particularly limited and is generally in an amount sufficient to generate enough energy to facilitate the rapid disintegration of the downhole articles once the energetic material is activated. In one embodiment, the energetic material is present in an amount of about 0.5 wt. % to about 45 wt. % or about 0.5 wt. % to about 20 wt. % based on the total weight of the disintegrable articles.

The disintegrable articles also include a sensor, which is operative to receive and process a signal to activate an energetic material, to determine a parameter change to trigger the activation of an energetic material, or to monitor a parameter of the disintegrable article, a downhole assembly comprising the disintegrable article, a well condition, or a combination comprising at least one of the foregoing. The parameter includes the disintegration status of the downhole article, the position of the downhole article, the position of the downhole assembly, pressure or temperature of the downhole environment, downhole fluid type, flow rate of produced water, or a combination comprising at least one of the foregoing. The sensor comprises a sensor material, a sensor element, or a combination comprising at least one of the foregoing. A disintegrable article can include more than one sensors, where each sensor can have the same or different functions.

To receive and process a signal to activate an energetic material, the sensor can include a receiver to receive a disintegration signal, and a triggering component that is effective to generate an electric current. Illustrative triggering component includes batteries or other electronic components. Once a disintegration signal is received, the triggering component generates an electric current and triggers the activation of the energetic material. The disintegration signal can be obtained from the surface of a wellbore or from a signal source in the well, for example, from a signal source in the well close to the disintegrable article.

In some embodiments, no external signal source is needed. The sensor can detect a parameter of interest such as a pressure, stress, or mechanical force applied to the disintegrable. Once the detected value exceeds a predetermined threshold value, the sensor generates an electrical signal which triggers the activation of the energetic material. Illustratively, a piezoelectric material can be used as the sensor material. The piezoelectric material detects a pressure such as hydraulic pressure, stress, or mechanical force applied to the downhole article. In the event that the detected pressure, stress, or mechanical force is greater than a predetermined value, the piezoelectric material generates an electrical charge to activate the energetic material.

The disintegrable sensor can also be configured to determine the disintegration status of the downhole article. For example, sensors with different tracer materials can be placed at different locations of the downhole article. The disintegration of the downhole article releases the tracer materials. Depending on the type of tracer materials detected, real time disintegration status can be determined. Alternatively or in addition, in the event that the matrix material releases a detectable chemical upon corrosion, the detectable chemical can also be used to provide disintegration information of the downhole article.

In some embodiments, the sensor includes chemical sensors configured for elemental analysis of conditions (e.g., fluids) within the wellbore. For example, the sensor can include carbon nanotubes (CNT), complementary metal oxide semiconductor (CMOS) sensors configured to detect the presence of various trace elements based on the principle of a selectively gated field effect transistors (FET) or ion sensitive field effect transistors (ISFET) for pH, $H_2S$ and other ions, sensors configured for hydrocarbon analysis, CNT, DLC based sensors that operate with chemical electropotential, and sensors configured for carbon/oxygen analysis. Some embodiments of the sensor may include a small source of a radioactive material and at least one of a gamma ray sensor or a neutron sensor.

The sensor can include other sensors such as pressure sensors, temperature sensors, stress sensors and/or strain sensors. For example, pressure sensors may include quartz crystals. Piezoelectric materials may be used for pressure sensors. Temperature sensors may include electrodes configured to perform resistivity and capacitive measurements that may be converted to other useful data. Temperature sensors can also comprise a thermistor sensor including a thermistor material that changes resistivity in response to a change in temperature.

In some embodiments, the sensor includes a tracer material such as an inorganic cation; an inorganic anion; an isotope; an activatable element; or an organic compound. Exemplary tracers include those described in US 20160209391. The tracer material can be released from the disintegrable articles while the articles disintegrate. The concentration of the release tracer material can be measured thus providing information such as concentration of water or flow rate of produced water.

The sensor may couple with a data processing unit. Such data processing unit includes electronics for obtaining and processing data of interest. The data processing unit can be located downhole or on the surface.

The microstructures of the exemplary disintegrable articles according to various embodiments of the disclosure are illustrated in FIGS. 1-4. Referring to FIG. 1, the disintegrable article 20 includes matrix 22, energetic material 24, and sensors 26. The energetic material forms an interconnected network. The sensors are randomly or purposely positioned in the disintegrable article.

Figure 2:
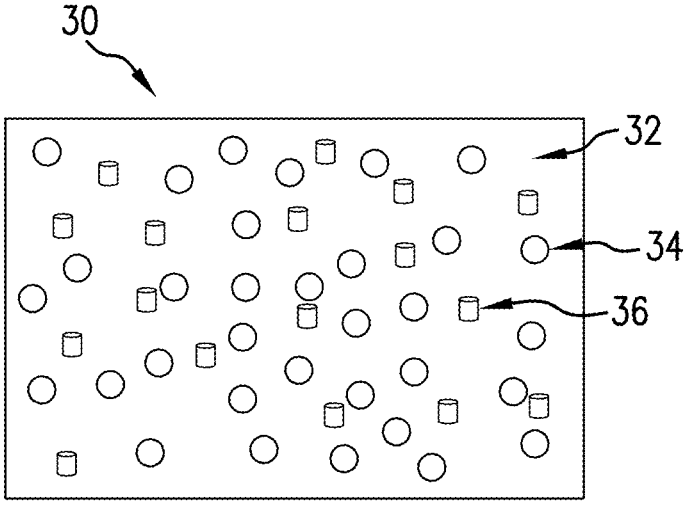
FIG. 2 is a schematic diagram of an exemplary disintegrable article that includes a matrix material, an energetic material, and a sensor, wherein the energetic material is randomly distributed in the matrix material.

The disintegrable article 30 illustrated in FIG. 2 includes matrix 32, energetic material 34, and sensors 36, where the energetic material 34 is randomly dispersed within matrix 32 as particles, pellets, short fibers, or a combination comprising at least one of the foregoing.

Figure 3:
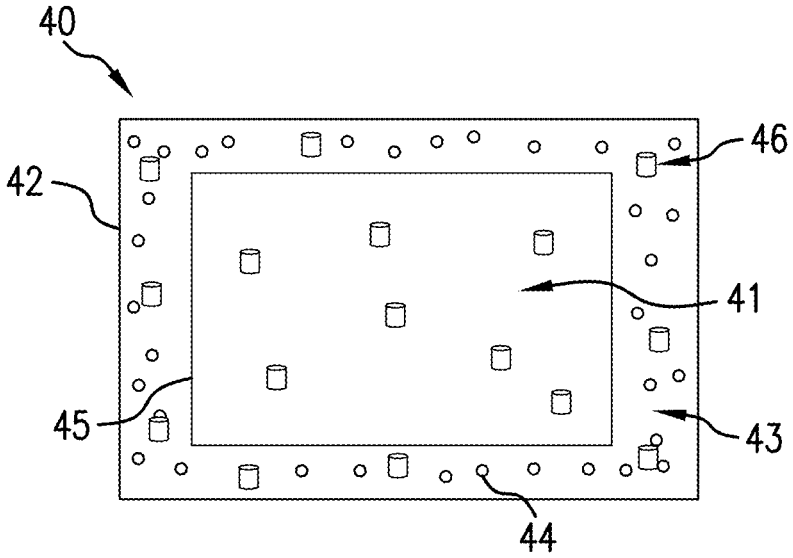
FIG. 3 is a schematic diagram of an exemplary disintegrable article that includes an inner portion and an outer portion disposed of the inner portion, the inner portion comprising a disintegrable material, and the outer portion comprising a matrix material and an energetic material.

The disintegrable article 40 illustrated in FIG. 3 includes an inner portion 45 and an outer portion 42, wherein the inner portion 45 contains a core material 41 and the outer portion 42 contains an energetic material 44 and matrix 43. Sensors 46 can be positioned in the inner portion 45, in the outer portion 42, or both. Although in FIG. 3, it is shown that the energetic material 44 is randomly distributed in the matrix 43 in the outer portion 42 of the disintegrable article 40, it is appreciated that the outer portion 42 can also have a structure as shown in FIG. 1 for article 20.

Figure 4:
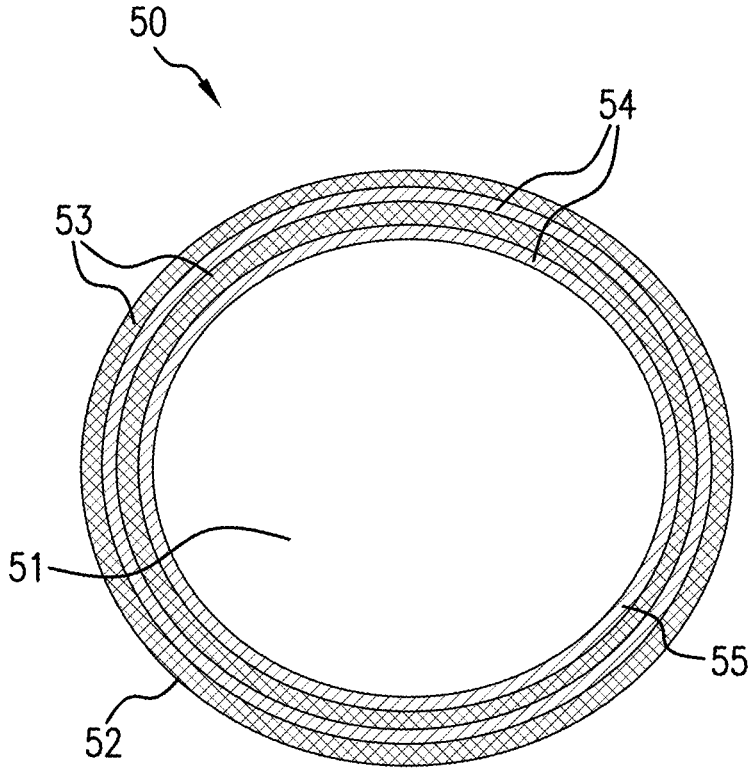
FIG. 4 is a schematic diagram of another exemplary disintegrable article that includes an inner portion and an outer portion disposed of the inner portion, wherein the outer portion includes a layered structure.

The disintegrable article 50 illustrated in FIG. 4 includes an inner portion 55 and an outer portion 52, wherein the inner portion 55 contains a core material 51 and the outer portion 52 has a layered structure that contains matrix layers 53 and energetic material layers 54. Sensors (not shown) can be disposed in the inner portion, the outer portion, or both.

Disintegrable articles in the downhole assembly are not particularly limited. Exemplary articles include a ball, a ball seat, a fracture plug, a bridge plug, a wiper plug, shear out plugs, a debris barrier, an atmospheric chamber disc, a swabbing element protector, a sealbore protector, a screen protector, a beaded screen protector, a screen basepipe plug, a drill in stim liner plug, ICD plugs, a flapper valve, a gaslift valve, a transmatic CEM plug, float shoes, darts, diverter balls, shifting/setting balls, ball seats, sleeves, teleperf disks, direct connect disks, drill-in liner disks, fluid loss control flappers, shear pins or screws, cementing plugs, teleperf plugs, drill in sand control beaded screen plugs, HP beaded frac screen plugs, hold down dogs and springs, a seal bore protector, a stimcoat screen protector, or a liner port plug. In specific embodiments, the disintegrable article is a ball, a fracture plug, a whipstock, a cylinder, or a liner plug. A downhole assembly comprising the disintegrable article is also provided.

The disintegrable articles disclosed herein can be controllably removed such that significant disintegration only occurs after these articles have completed their functions. A method of controllably removing a disintegrable article comprises disposing a disintegrable article comprising a matrix material, an energetic material, and a sensor in a downhole environment; performing a downhole operation; activating the energetic material; and disintegrating the downhole article.

The method further comprises determining a parameter of the downhole article, a downhole assembly comprising the downhole article, the downhole environment, or a combination comprising at least one of the foregoing. The parameter comprises disintegration status of the downhole article, the position of the downhole article, position of the downhole assembly, pressure or temperature of the downhole environment, flow rate of produced water, or a combination comprising at least one of the foregoing.

The methods allow for a full control of the disintegration profile. The disintegrable articles can retain their physical properties until a signal or activation command is produced. Because the start of the disintegration process can be controlled, the disintegrable articles can be designed with an aggressive corrosion rate in order to accelerate the disintegration process once the articles are no longer needed.

The disintegrable article or a downhole assembly comprising the same can perform various downhole operations while the disintegration of the article is minimized. The downhole operation is not particularly limited and can be any operation that is performed during drilling, stimulation, completion, production, or remediation.

Once the disintegrable article is no longer needed, the disintegration of the article is activated. The method can further comprise receiving an instruction or signal from above the ground or generating an instruction or signal downhole to activate the energetic material. Activating the energetic material comprises providing a command signal to the downhole article, the command signal comprising electric current, electromagnetic radiation such as microwaves, laser beam, mud pulse, hydraulic pressure, mechanical fore, or a combination comprising at least one of the foregoing.

The command signal can be provided above the surface or generated downhole. In an embodiment, activating the energetic material comprises detecting a pressure, stress, or mechanical force applied to the disintegrable article to generate a detected value; comparing the detected value with a threshold value; and generating an electrical change to activate the energetic material when the detected value exceeds the threshold value. In another embodiment, activating the energetic material includes receiving a command signal by the sensor, and generating an electric current by the sensor to activate the energetic material. Activating the energetic material can further comprise initiating a reaction of the energetic material to generate heat.

Figure 5:
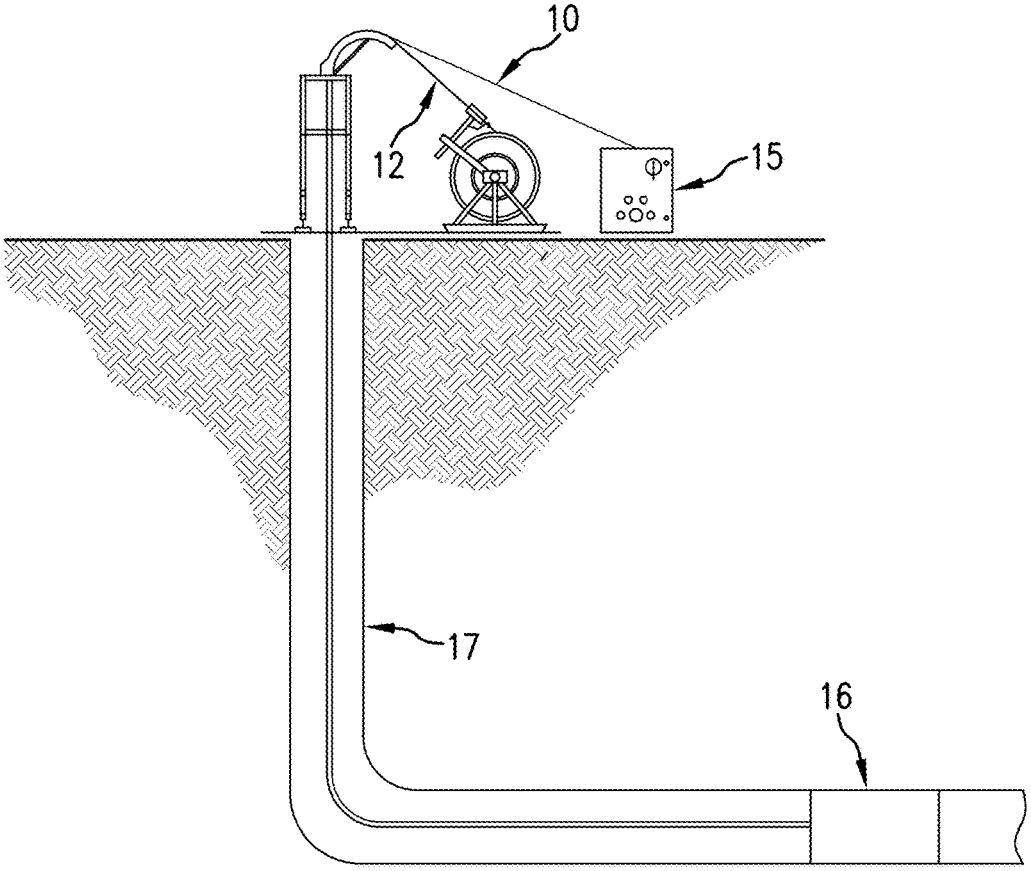
FIG. 5 is a schematic diagram illustrating a downhole assembly disposed in a downhole environment according to an embodiment of the disclosure.

Referring to FIG. 5, a downhole assembly 16 is disposed in wellbore 17 via a coil tubing or wireline 12. A communication line 10 couples the downhole assembly to a processor 15. The communication line 10 can provide a command signal such as a selected form of energy from processor 15 to the downhole assembly to activate the energetic material in the downhole assembly. The communication line 10 can also process the data generated by the sensor in the disintegrable article to monitor the disintegration status of the downhole assembly, position of the downhole assembly and the well conditions. The communication line 10 can be optical fibers, electric cables or the like, and it can be placed inside of the coil tubing or wireline 12.

Figure 6A:
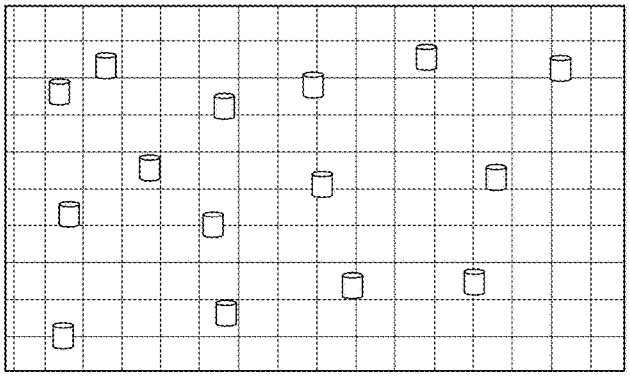
FIGS. 6A-6F illustrate a process of disintegrating a downhole article according to an embodiment of the disclosure, where
Figure 6B:
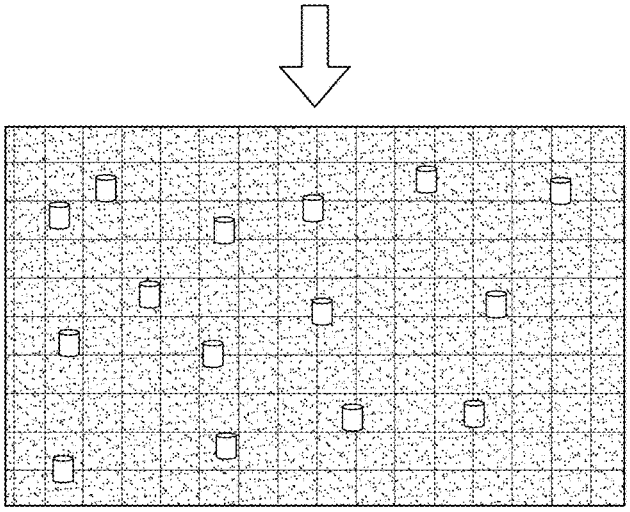
Figure 6C:
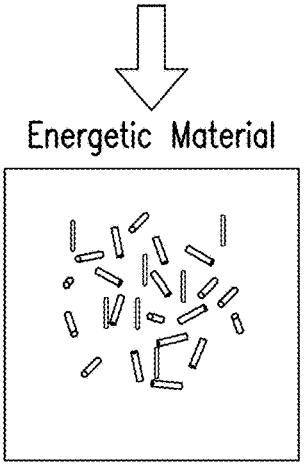
Figure 6D:
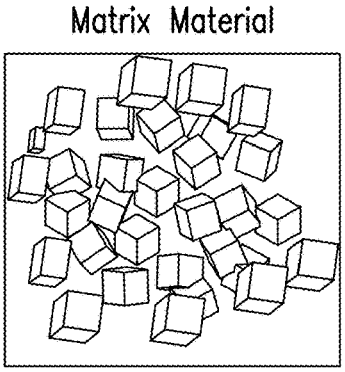
Figure 6E:
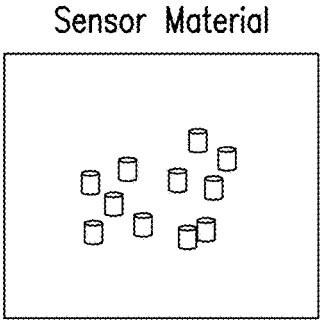
Figure 6F:
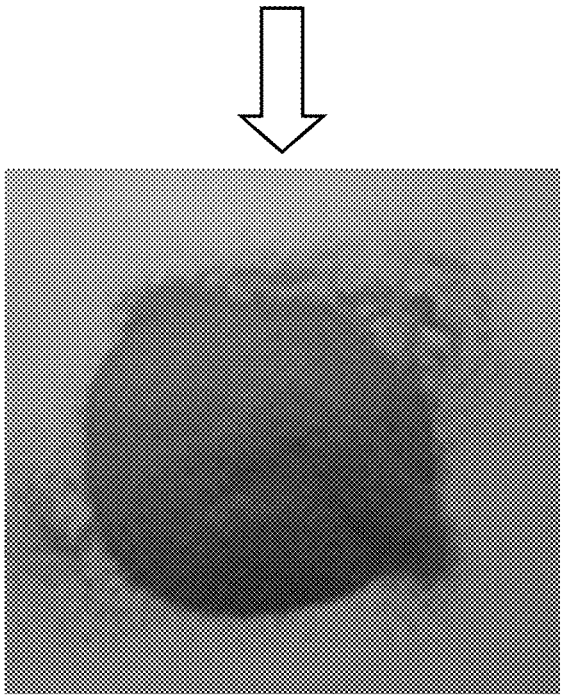

Referring to FIGS. 6A-6E, before activation a disintegrable article as shown in FIG. 6A contains an energetic material network, a matrix, and sensors. After activation heat is generated, and the disintegration article as shown in FIG. 6B breaks into small pieces, such as an energetic material, a matrix material, and a sensor material as shown in FIGS. 6C, 6D, and 6E respectively. In an embodiment, the small pieces can further corrode in a downhole fluid forming powder particles as shown in FIG. 6F. The powder particles can flow back to the surface thus conveniently removed from the wellbore.

Set forth below are various embodiments of the disclosure.

Embodiment 1

A downhole assembly comprising a disintegrable article that includes a matrix material; an energetic material configured to generate energy upon activation to facilitate the disintegration of the disintegrable article; and a sensor.

Embodiment 2

The downhole assembly of Embodiment 1, wherein the sensor is operative to receive and process a signal to activate the energetic material, to determine a parameter change to trigger the activation of the energetic material, to monitor a parameter of the disintegrable article, the downhole assembly, a well condition, or a combination comprising at least one of the foregoing.

Embodiment 3

The downhole assembly of Embodiment 1 or Embodiment 2, wherein the sensor is configured to monitor the disintegration status of the disintegrable article.

Embodiment 4

The downhole assembly of any one of Embodiments 1 to 3, wherein the energetic material comprises interconnected continuous fibers, wires, foils, or a combination comprising at least one of the foregoing.

Embodiment 5

The downhole assembly of any one of Embodiments 1 to 4, wherein the energetic material comprises continuous fibers, wires, or foils, or a combination comprising at least one of the foregoing, which form a three dimensional network; and the matrix material is distributed throughout the three dimensional network.

Embodiment 6

The downhole assembly of any one of Embodiments 1 to 3, wherein the energetic material is randomly distributed in the matrix material in the form of particles, pellets, short fibers, or a combination comprising at least one of the foregoing.

Embodiment 7

The downhole assembly of any one of Embodiments 1 to 3, wherein the disintegrable article comprises an inner portion and an outer portion disposed of the inner portion, the inner portion comprising a core material that is corrodible in a downhole fluid; and the outer portion comprising the matrix material and the energetic material.

Embodiment 8

The downhole assembly of any one of Embodiments 1 to 3, wherein the disintegrable article comprises an inner portion and an outer portion disposed of the inner portion, the inner portion comprising a core material that is corrodible in a downhole fluid; and the outer portion having a layered structure comprising one or more energetic material layers and one or more matrix material layers.

Embodiment 9

The downhole assembly of Embodiment 7 or 8, wherein the sensor is disposed in the inner portion of the disintegrable article, the outer portion of the disintegrable article, or both.

Embodiment 10

The downhole assembly of any one of Embodiments 7 to 9, wherein the core material and the matrix material are selected such that the core material has a higher corrosion rate than the matrix material when tested under the same conditions.

Embodiment 11

The downhole assembly of any one of Embodiments 7 to 10, wherein the inner portion is encased within the outer portion.

Embodiment 12

The downhole assembly of any one of Embodiments 1 to 11, wherein the matrix material comprises one or more of the following: a polymer; a metal; or a composite.

Embodiment 13

The downhole assembly of Embodiment 12, wherein the matrix material is not corrodible in a downhole fluid.

Embodiment 14

The downhole assembly of Embodiment 12, wherein the matrix material is corrodible in a downhole fluid.

Embodiment 15

The downhole assembly of Embodiment 14, wherein the matrix material comprises Zn, Mg, Al, Mn, an alloy thereof, or a combination comprising at least one of the foregoing.

Embodiment 16

The downhole assembly of Embodiment 15, wherein the matrix material further comprises Ni, W, Mo, Cu, Fe, Cr, Co, an alloy thereof, or a combination comprising at least one of the foregoing.

Embodiment 17

The downhole assembly of any one of Embodiments 1 to 16, wherein the energetic material comprises a thermite, a reactive multi-layer foil, an energetic polymer, or a combination comprising at least one of the foregoing.

Embodiment 18

The downhole assembly of Embodiment 17, wherein the thermite comprises a reducing agent comprising aluminum, magnesium, calcium, titanium, zinc, silicon, boron, and a combination comprising at least one of the foregoing reducing agent, and an oxidizing agent comprising boron oxide, silicon oxide, chromium oxide, manganese oxide, iron oxide, copper oxide, lead oxide, and a combination comprising at least one of the foregoing oxidizing agent.

Embodiment 19

The downhole assembly of Embodiment 17, wherein the energetic polymer comprises a polymer with azide, nitro, nitrate, nitroso, nitramine, oxetane, triazole, tetrazole containing groups, or a combination comprising at least one of the foregoing.

Embodiment 20

The downhole assembly of Embodiment 17, wherein the reactive multi-layer foil comprises aluminum layers and nickel layers or the reactive multi-layer foil comprises titanium layers and boron carbide layers.

Embodiment 21

The downhole assembly of any one of Embodiments 1 to 20, wherein the energetic material is present in an amount of about 0.5 wt. % to about 45 wt. % based on the total weight of the disintegrable article.

Embodiment 22

The downhole assembly of any one of Embodiments 1 to 21, wherein the sensor comprises a sensor material, a sensor element, or a combination comprising at least one of the foregoing.

Embodiment 23

A method of controllably removing a disintegrable downhole article, the method comprising: disposing the downhole article in a downhole environment, the downhole article including a matrix material, an energetic material configured to generate energy upon activation to facilitate the disintegration of the downhole article, and a sensor; performing a downhole operation; activating the energetic material; and disintegrating the downhole article.

Embodiment 24

The method of Embodiment 23, further comprising determining a parameter of the downhole article, a downhole assembly comprising the downhole article, the downhole environment, or a combination comprising at least one of the foregoing.

Embodiment 25

The method of Embodiment 24, wherein the parameter comprises disintegration status of the downhole article, position of the downhole article, position of the downhole assembly, pressure or temperature of the downhole environment, flow rate of produced water, or a combination comprising at least one of the foregoing.

Embodiment 26

The method of any one of Embodiments 23 to 25, wherein activating the energetic material comprises providing a command signal to the downhole article, the command signal comprising electric current, electromagnetic radiation, laser beam, mud pulse, hydraulic pressure, mechanical force, or a combination comprising at least one of the foregoing.

Embodiment 27

The method of any one of Embodiments 23 to 26, further comprising detecting a pressure, stress, or mechanical force applied to the disintegrable article to generate a detected value; comparing the detected value with a threshold value; and generating an electrical charge to activate the energetic material once the detected value exceeds the threshold value.

Embodiment 28

The method of any one of Embodiments 23 to 27, wherein activating the energetic material further comprises initiating a reaction of the energetic material to generate heat.

All ranges disclosed herein are inclusive of the endpoints, and the endpoints are independently combinable with each other. As used herein, "combination" is inclusive of blends, mixtures, alloys, reaction products, and the like. All references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity).

What is claimed is:

1. A downhole assembly comprising a disintegrable article that includes a matrix material;

an energetic material configured to generate energy upon activation to facilitate the disintegration of the disintegrable article; and a sensor, wherein the energetic material is present in an amount of about 0.5 wt. % to about 45 wt. % based on the total weight of the disintegrable article.

2. The downhole assembly of claim 1, wherein the sensor is operative to receive and process a signal to activate the energetic material, to determine a parameter change to trigger the activation of the energetic material, to monitor a parameter of the disintegrable article, the downhole assembly, a well condition, or a combination comprising at least one of the foregoing.

3. The downhole assembly of claim 1, wherein the sensor is configured to monitor the disintegration status of the disintegrable article.

4. The downhole assembly of claim 1, wherein the energetic material comprises interconnected continuous fibers, wires, foils, or a combination comprising at least one of the foregoing.

5. The downhole assembly of claim 1, wherein the energetic material comprises continuous fibers, wires, or foils, or a combination comprising at least one of the foregoing, which form a three dimensional network; and the matrix material is distributed throughout the three dimensional network.

6. The downhole assembly of claim 1, wherein the energetic material is randomly distributed in the matrix material in the form of particles, pellets, short fibers, or a combination comprising at least one of the foregoing.

7. The downhole assembly of claim 1, wherein the disintegrable article comprises an inner portion and an outer portion disposed of the inner portion, the inner portion comprising a core material that is corrodible in a downhole fluid; and the outer portion having a layered structure comprising one or more energetic material layers and one or more matrix material layers.

8. The downhole assembly of claim 1, wherein the sensor comprises a sensor material, a sensor element, or a combination comprising at least one of the foregoing.

9. The downhole assembly of claim 1, wherein the disintegrable article comprises an inner portion and an outer portion disposed of the inner portion, the inner portion comprising a core material that is corrodible in a downhole fluid; and the outer portion comprising the matrix material and the energetic material.

10. The downhole assembly of claim 9, wherein the sensor is disposed in the inner portion of the disintegrable article, the outer portion of the disintegrable article, or both.

11. The downhole assembly of claim 9, wherein the core material and the matrix material are selected such that the core material has a higher corrosion rate than the matrix material when tested under the same conditions.

12. The downhole assembly of claim 9, wherein the inner portion is encased within the outer portion.

13. The downhole assembly of claim 1, wherein the matrix material comprises one or more of the following: a polymer; a metal; or a composite.

14. The downhole assembly of claim 13, wherein the matrix material is not corrodible in a downhole fluid.

15. The downhole assembly of claim 13, wherein the matrix material is corrodible in a downhole fluid.

16. The downhole assembly of claim 15, wherein the matrix material comprises Zn, Mg, Al, Mn, an alloy thereof, or a combination comprising at least one of the foregoing.

17. The downhole assembly of claim 16, wherein the matrix material further comprises Ni, W, Mo, Cu, Fe, Cr, Co, an alloy thereof, or a combination comprising at least one of the foregoing.

18. The downhole assembly of claim 1, wherein the energetic material comprises a thermite, a reactive multi-layer foil, an energetic polymer, or a combination comprising at least one of the foregoing.

19. The downhole assembly of claim 18, wherein the thermite comprises a reducing agent comprising aluminum, magnesium, calcium, titanium, zinc, silicon, boron, and a combination comprising at least one of the foregoing reducing agent, and an oxidizing agent comprising boron oxide, silicon oxide, chromium oxide, manganese oxide, iron oxide, copper oxide, lead oxide, and a combination comprising at least one of the foregoing oxidizing agent.

20. A downhole assembly comprising a disintegrable article that includes a matrix material; an energetic material configured to generate energy upon activation to facilitate the disintegration of the disintegrable article; and a sensor; wherein the energetic material comprises an energetic polymer, which comprises a polymer with azide, nitro, nitrate, nitroso, nitramine, oxetane, triazole, tetrazole containing groups, or a combination comprising at least one of the foregoing.

21. A downhole assembly comprising a disintegrable article that includes a matrix material; an energetic material configured to generate energy upon activation to facilitate the disintegration of the disintegrable article; and a sensor; wherein the energetic material comprises a reactive multi-layer foil, the reactive multi-layer foil comprises titanium layers and boron carbide layers.

22. A method of controllably removing a disintegrable downhole article, the method comprising:

disposing the downhole assembly of claim 1 which comprises the downhole article in a downhole environment;

performing a downhole operation;

activating the energetic material; and disintegrating the downhole article.

23. The method of claim 22, further comprising determining a parameter of the downhole article, a downhole assembly comprising the downhole article, the downhole environment, or a combination comprising at least one of the foregoing.

24. The method of claim 23, wherein the parameter comprises disintegration status of the downhole article, position of the downhole article, position of the downhole assembly, pressure or temperature of the downhole environment, flow rate of produced water, or a combination comprising at least one of the foregoing.

25. The method of claim 22, wherein activating the energetic material comprises providing a command signal to the downhole article, the command signal comprising electric current, electromagnetic radiation, laser beam, mud pulse, hydraulic pressure, mechanical force, or a combination comprising at least one of the foregoing.

26. The method of claim 22, further comprising detecting a pressure, stress, or mechanical force applied to the disintegrable article to generate a detected value; comparing the detected value with a threshold value; and generating an electrical charge to activate the energetic material once the detected value exceeds the threshold value.

27. The method of claim 22, wherein activating the energetic material further comprises initiating a reaction of the energetic material to generate heat.

* * * * *